United States Patent [19]

Umholtz

[11] 4,030,192

[45] June 21, 1977

[54] MAT CUTTER FOR CIRCLES

[75] Inventor: Franklyn G. Umholtz, Shutesbury, Mass.

[73] Assignee: Russell Harrington Cutlery, Inc., Southbridge, Mass.

[22] Filed: May 25, 1976

[21] Appl. No.: 689,794

[52] U.S. Cl. ..... 30/310
[51] Int. Cl.² ..... B26B 3/00
[58] Field of Search ..... 30/310

[56] References Cited

UNITED STATES PATENTS

| | | | |
|---|---|---|---|
| 396,600 | 1/1889 | Rowland | 30/310 X |
| 2,716,282 | 8/1955 | Kromsten | 30/310 |
| 2,924,010 | 2/1960 | Umholtz | 30/293 |

FOREIGN PATENTS OR APPLICATIONS

| | | | |
|---|---|---|---|
| 589,877 | 12/1933 | Germany | 30/310 |
| 1,248,866 | 10/1971 | United Kingdom | 30/310 |

*Primary Examiner*—James L. Jones, Jr.
*Assistant Examiner*—J. T. Zatarga
*Attorney, Agent, or Firm*—Charles R. Fay

[57] ABSTRACT

A mat cutter substantially according to U.S. Pat. No. 2,924,010 dated Feb. 6, 1960, with the addition of a vertical radius bar having an adjustable center point, and means for attaching the bar to the mat cutter body with the point of the cutting blade substantially in line with the center point about which the mat cutter pivots, to cut generally exact circles. The mechanism holding the blade to the mat cutter body is utilized to secure the vertical radius rod in position.

5 Claims, 5 Drawing Figures

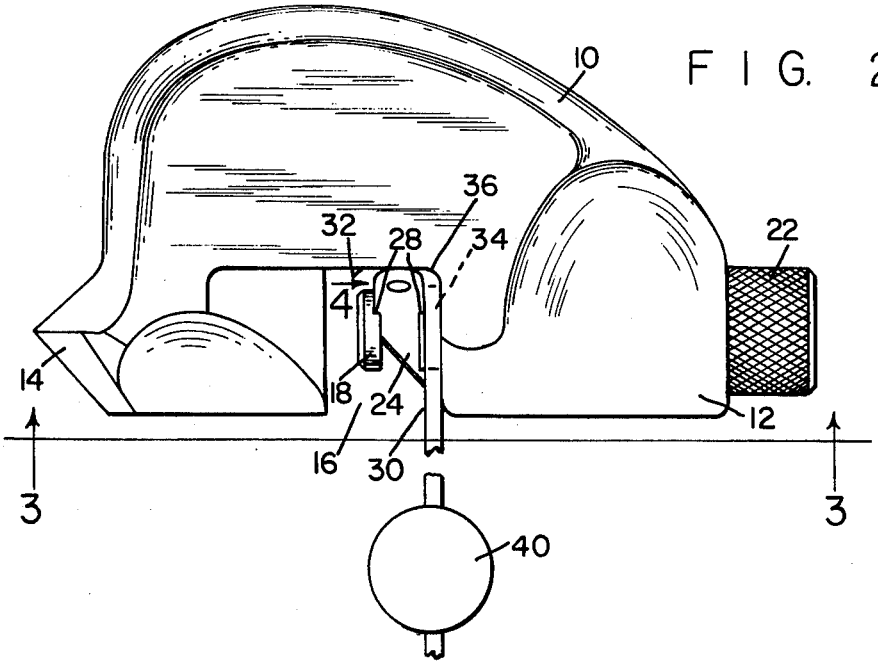
FIG. 2
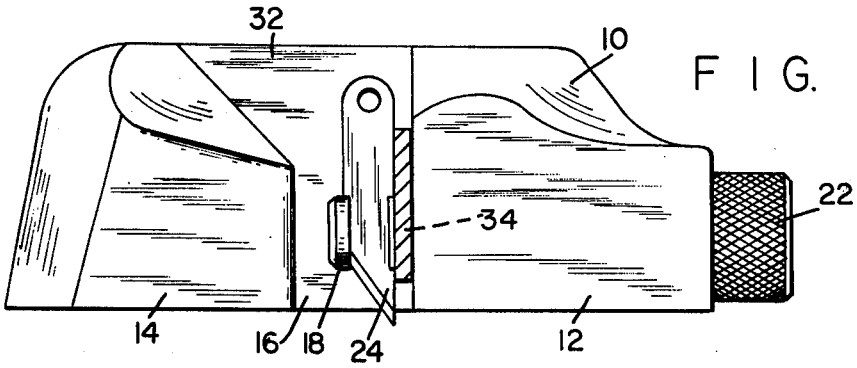
FIG. 3
FIG. 5
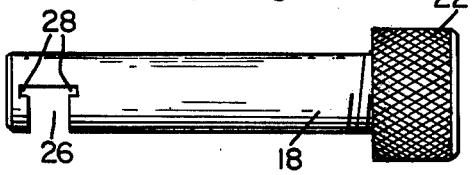
FIG. 4
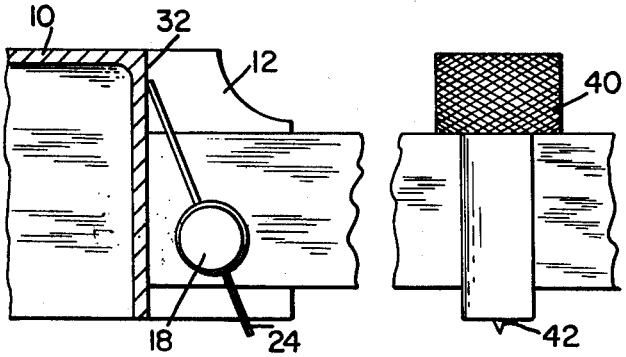

MAT CUTTER FOR CIRCLES

BACKGROUND OF THE INVENTION

There are several mat cutters on the market one of which is manufactured according to U.S. Pat. No. 2,924,010, but these cutters generally do not have means to guide the tool for cutting circles in mats; and it is desirable that some kind of accurate guide should be provided for such mat cutters to circumscribe circles and cut them with as much exactness as is possible. It is the purpose of the present invention to provide an attachment for an already existing mat cutter which will quickly and easily cut circles.

SUMMARY OF THE INVENTION

The mat cutter of the present invention includes a body having a pair of parallel arms with a gap therebetween, the cutter body being substantially U-shaped, for easy manipulation thereof. A blade is secured between the arms by a shaft which extends through one of the arms and has screw threaded means for clamping the blade in position, said shaft having a free-ended portion for holding the blade, said free-ended portion having a recess therein for maintaining the blade in angularly adjusted position about the axis of the shaft. The recess in the shaft has a pair of facing side walls in which there are provided diametrical grooves in the shaft for holding the blade. The screw maintains the blade tightly against a face of one of the inside surfaces of the arm of said U-shaped body that holds the shaft.

In the present invention a vertical radius rod is provided with a circular aperture near one end, this aperture fitting over The shaft against the face of the arm of the U-shaped body of the mat cutter against which formerly an edge of the blade was firmly secured, (see U.S. Pat. No. 2,924,010). The edge of the blade contacts the radius rod, and as the shaft is moved by the screw in the clamping direction, the blade clamps the radius rod to the inside surface of said arm.

The knife blade is sharpened on an angle with the point below the lower edge of the radius rod and this point is substantially in line with a sharp center point which is adjustable along the radius rod to find the center of the circular mat to be cut out, and since the blade moves in line with said center, the circle cut out is substantially perfect.

BRIEF DESCRIPTION OF THE DRAWINGS

FIG. 2 is a top plan view thereof;

FIG. 3 is a sectional view through the radius rod on line 3—3 of FIG. 2, the mat cutter being in elevation;

FIG. 4 is a view in elevation, partly in section looking in the direction of arrow 4 in FIG. 1; and FIG. 5 is a view in elevation of the cutter holding shaft.

PREFERRED EMBODIMENT OF THE INVENTION

Figure 1:
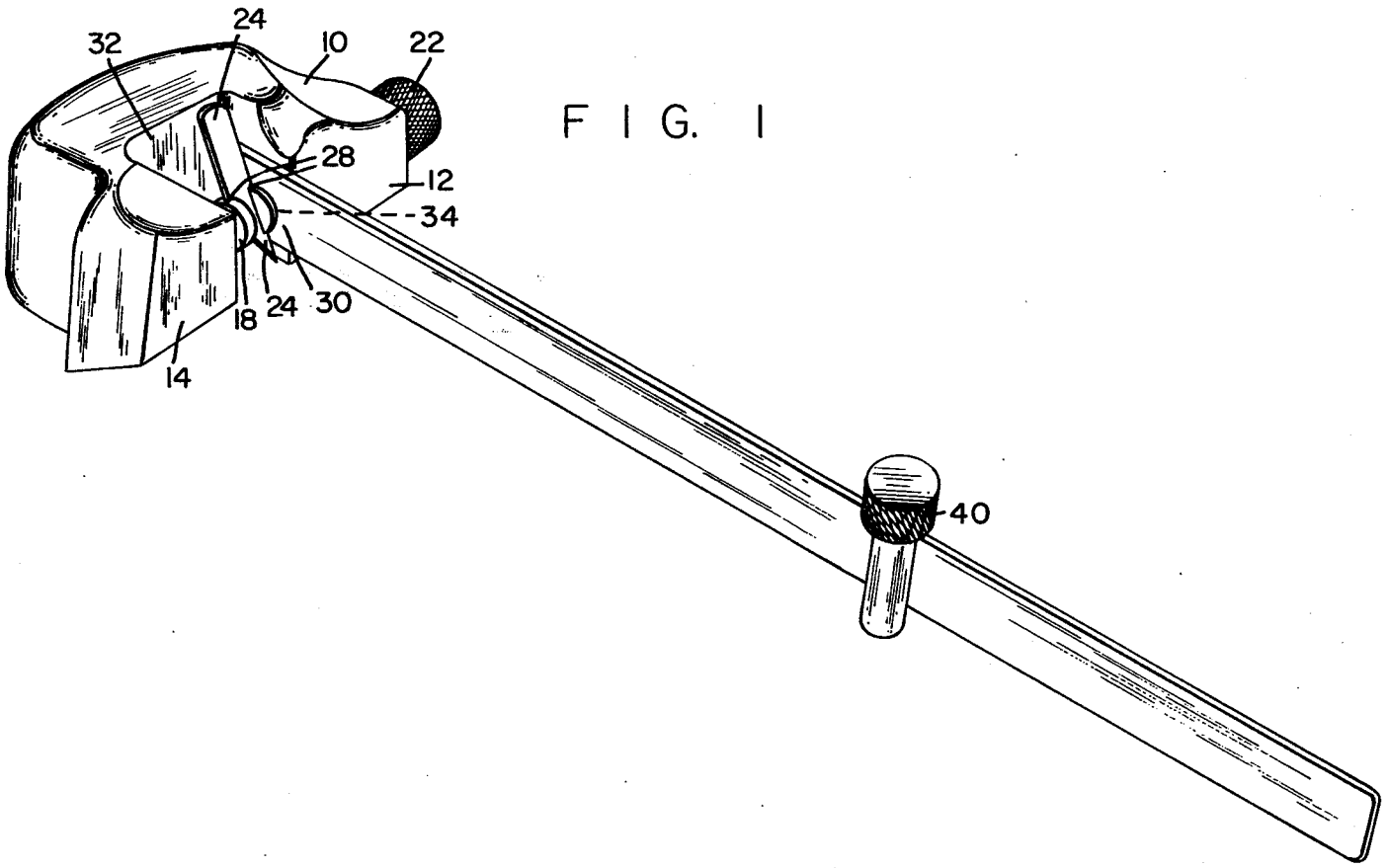
FIG. 1 is a perspective view showing the invention.

Reference is hereby made to U.S. Pat. No. 2,924,010, Feb. 6, 1960, showing a mat cutter upon which the present invention is based. A body 10 is provided with a pair of spaced arms 12 and 14 forming a gap 16 between them. A shaft 18 is screw-threaded at one end as at 20 to accept a nut 22. The shaft extends through the arm 12 which supports it and the nut 22 bears against a side wall of body 10 so as to longitudinally adjust the shaft in the arm 12 for clamping the blade generally indicated at 24.

This is done by means of a recess 26. The recess has two opposed faces which have corresponding facing grooves 28 therein which slidingly receive the blade as perhaps best shown in FIG. 1. Upon tightening of nut 22, one of the blade edges is tightened against the face 30 of the arm 12 and of course it may be rotatably adjusted as desired with a limit against the rear wall 32 of the gap between the arms 12 and 14.

The radius rod of the present invention is an elongated rod which may be conveniently made of metal. At one end it has an aperture therein as at 34 receiving the free end of the shaft as shown in FIGS. 1 and 2, and it is held in a vertical plane in a horizontal position since its inner end abuts the rear face 32 of the gap as at 36. As described above, when the blade 24 is drawn into contact with the face 30 of the arm 12, it is clamped in position; but with the radius rod interposed between the blade and surface 30, now the radius rod is clamped in this position as well as the blade. The point 42 and its holder are clamped by a well-known thumbscrew 40. All that is necessary is to find the center desired, engage the point 42 therewith, and run the mat cutter around in a circle of the desired diameter. The blade edge is at an angle to the vertical and its point is substantially in line with the center point 42, thereby making a draw cut. This insures a smooth and easy cut when making circular mats.

I claim:

1. A mat cutter comprising a body, a blade, means mounting a shaft in the body, the shaft being threaded at one end with a nut thereon and free-ended at the opposite end, said opposite end having a generally side opening recess therein for the reception of the blade, said mat cutter including a wall against which the blade may be clamped by the shaft, a radius rod, said radius rod having an opening therein for the reception of the free-ended portion of said shaft, said blade engaging the rod and holding it in position against said wall upon tightening of the nut on the shaft, and a center point on the rod, said center point being adjustable therealong.

2. The mat cutter of claim 1 wherein said radius rod is positioned in a vertical plane.

3. The mat cutter of claim 2 wherein the blade includes a sharp point substantially aligned with the centerpoint along the radius rod.

4. The mat cutter of claim 1 wherein said recess includes spaced opposed walls and including diametrical spaced slots in the walls of the recess, the blade being slidable at its edges in said slots.

5. The mat cutter of claim 1 wherein said body includes two spaced arms forming a gap, said gap having a rear wall, the free end of the shaft and the blade being in the gap, and the rod having a flat end near the opening and engaging the rear wall of the gap.

* * * * *